US005662531A

United States Patent [19]

Durso

[11] Patent Number: 5,662,531

[45] Date of Patent: Sep. 2, 1997

[54] GOLF SWING TRAINING MAT FOR HIGHLY AUTHENTIC PRACTICE

[75] Inventor: Joseph M. Durso, Reston, Va.

[73] Assignee: IBEX Golf, L.C., Reston, Va.

[21] Appl. No.: 695,974

[22] Filed: Aug. 13, 1996

Related U.S. Application Data

[63] Provisional application Ser. No. 60/010,562, Jan. 25, 1996, and a continuation-in-part of Ser. No. 541,734, Oct. 10, 1995, abandoned.

[51] Int. Cl.[6] ..... A63B 57/00

[52] U.S. Cl. ..... 473/278; 473/400

[58] Field of Search ..... 473/278, 279, 473/386, 387, 132, 133, 218, 400, 398, 402, 396

[56] References Cited

U.S. PATENT DOCUMENTS

| | | | |
|---|---|---|---|
| 2,370,529 | 2/1945 | Fuller | 473/278 |
| 3,599,982 | 8/1971 | Elesh | 473/278 |
| 3,844,558 | 10/1974 | Gigliotti | 473/278 |
| 3,869,128 | 3/1975 | Ohashi | 473/278 |
| 4,387,896 | 6/1983 | O'Brien | 473/278 |
| 5,035,433 | 7/1991 | Durso . | |
| 5,310,177 | 5/1994 | Conrad et al. | 473/386 |
| 5,354,064 | 10/1994 | Toikka | 473/278 |
| 5,356,147 | 10/1994 | MacDonald | 473/278 |
| 5,443,870 | 8/1995 | Lurie et al. | 473/278 |

FOREIGN PATENT DOCUMENTS

92/01496 2/1992 WIPO .

*Primary Examiner*—Steven B. Wong
*Attorney, Agent, or Firm*—Christopher John Rudy

[57] ABSTRACT

Golf swing training mat for highly authentic practice includes a support surface; a standing surface; a hitting surface separate from the standing surface and removably attachable to the support surface and having an area thereof designated as a front hitting area, which is made of a material that nearly looks and gives a feeling of real grass and that is not easily destroyed by repeated swings of a golf club striking the material—preferably, the front hitting area being present in conjunction with an overhang, or a generally open underpass; and a follow through notch ahead of the hitting surface, in part defined by an obliquely-angled edge, generally obliquely angled to and abutting a front edge of the hitting surface, which envoids an area such that a golfer when swinging an iron can properly follow through downwardly after striking a golf ball into the downwardmost portion of the swing when the ball is struck near the front hitting area, and which allows for the golfer to follow through without striking the obliquely-angled edge segment. Thus, the golfer can be encouraged in realistic practice from a durable mat, especially with iron shots, and bounce-back or shock can generally be eliminated. And so, numerous, fluid iron strokes can be practiced generally without mat-caused interruption. A tongue and tee slot, a rubber tee height adjusting hole and cavity, etc., may be present.

19 Claims, 10 Drawing Sheets

GOLF SWING TRAINING MAT FOR HIGHLY AUTHENTIC PRACTICE

CROSS-REFERENCES

This is a continuation-in-part of application Ser. No. 08/541,734 filed Oct. 10, 1995 now abandoned and claims the benefit of provisional application Ser. No. 60/010,562 filed Jan. 25, 1996. Those two specifications are incorporated herein by reference.

FIELD

This invention concerns a golf practice article, its preparation and use. It may particularly concern the type of golf swing practice mat having a follow through notch. It may further particularly concern a golf swing practice mat having a portion of its hitting surface spaced apart from or above a solid underlying substance such as a base portion or the ground and/or having separable unit components and/or having a practice tee adjustment feature.

BACKGROUND

Until the advent of wire or bristle brush mats to mats of polyurethane or nylon materials that look and give more of the same feeling as real grass, even with a thick, soft underpad cushioning and large 5×5-feet (1.5×1.5-meter) square surface, people had not been able to practice their driving golf stroke from a surface that is somewhat similar to natural turf yet is not destroyed with each strike of the ball. However, such mats are problematical, particularly when it comes to practicing the iron stroke where a divot is to be taken after striking the ball, in that the practicing golfer experiences shock from his club striking down on the mat, which subsequently leads to the formation of bad iron swing habits, as, to avoid the shock, the practicing golfer brushes the ball off the mat surface and never learns the correct stroke. Such bad swing habits carry over onto the actual golf course. Accordingly, better golfers prefer not to hit practice balls, especially with irons, off such mats.

In addressing the problem, Mr. Joseph M. Durso invented and disclosed a golf swing training mat, U.S. Pat. No. 5,035,433 (Jul. 30, 1991). See also, Durso, WO 92/01496 (06.02.92). The Durso mat has a follow through notch, and hence, for the first time, a golfer was able to practice his golf stroke, especially his iron stroke, effectively, from a generally durable, realistic-swing-providing practice mat.

However, even the mat disclosed by Mr. Durso is found to be in need of improvement. For example, although actual models of the Durso mat perform satisfactorily in general in the field, the following shortcomings are encountered:

1) With extended use, predominantly, the hitting surface wears, and even though the front hitting edge can be renewed by cutting, which can be a rather difficult job, the hitting surface again wears, and the entire mat must be replaced even though the standing area may be in serviceable shape. Replacement may be an expensive endeavor.
2) Although shock is generally eliminated when an iron stroke is practiced, the occasional "fat" hit could leave Just a bit of a reminder that one was still on an artificial practice mat.
3) Emplacement of a tee could be cumbersome, as when a standard rubber tee is to be inserted, the relatively heavy mat needs to be lifted off the ground a fair amount.
4) The placement of a ball on the artificial hitting surface as for an iron shot leaves the ball up somewhat high in comparison to the position a ball generally takes when it lies in natural turf. This engenders a less than authentic swing in itself as the golfer may "pick" the ball off this type of lie with his swing rather than attempt the proper divot-taking shot.
5) A rubber tee as for practicing driver shots is not adjustable without removing the tee and replacing it with another having shorter posts for teeing up the ball as for 2-, 3-, 4-, and 5-wood practice shots. Varied height tees are not usually convenient; so, practice is often disrupted.

Accordingly, further improvement in the art is desired.

SUMMARY

The present invention provides a golf swing training mat for highly authentic practice comprising the following:

a support surface;

a standing surface;

a hitting surface separate from the standing surface and removably attachable to the support surface and having an area thereof designated as a front hitting area, which is made of a material that nearly looks and gives a feeling of real grass and that is not easily destroyed by repeated swings of a golf club striking the material; and a follow through notch, also known as a divot area, ahead of the hitting surface in part defined by an obliquely-angled edge generally obliquely angled to and abutting a front edge of the hitting surface, which envoids an area such that a golfer when swinging an iron can properly continue downwardly after striking a golf ball with the iron into the downwardmost portion of the swing after the ball is struck near the front hitting area, and which also allows for the golfer to follow through in a practice swing without striking the obliquely-angled edge segment such that the golfer is able to and can be encouraged to realistically practice hitting down and through the ball as is to be done with an iron shot to obtain good backspin, and hence, loft, and such that bounce-back or shock can generally be eliminated, and the golfer can thus practice a fluid iron stroke generally without mat-caused interruption.

A tongue and tee slot may be provided. Such may be alone or generally in subsurface position at the front edge of the hitting area as in the present mat. A turf slot may be provided also. These may be in the present mat or many others, large or small. Additional features may be present.

For example, the present invention can provide a mat for authentic golf swing training, which includes notable features such as in large mat, having pieces thereof; another, a symmetrical arrangement thereof; another, interlocking pieces, especially which may be arranged in combination with an overlying layer to assist in their remaining connected during golf swing training and which may be provided for ready replacement. Another includes novel "divot" simulating voids present as a hitting surface overhang, or a generally open underpass thereto. The underpass may include a platform open on one side and supported on remaining sides. Another includes rubber tee adjustment means, especially as a rubber tee height adjusting hole and cavity.

The invention is useful in recreation. The same may be employed in golf instruction methods and in golf practice.

Significantly, by the invention, a more cost-effective golf swing training mat is provided as the hitting surface(s) can be replaced or repositioned efficiently without having to replace the entire mat. The mat provides for highly authentic practice, and even smoother, more fluid practice of iron shots, especially with a hitting area bridge feature, and a more authentic-appearing environment may be provided. Damage to the practicing golfer's clubs and/or wrists may be avoided. The tee slot can accommodate a standard rubber tee, readily, and the turf slot can accommodate a golf ball to more authentically position it as if it were settled into turf as occurs with balls on an actual course. An extension or the base or tongue can further absorb shock while providing more give at the strike area, and provide for significantly longer wear in addition.

Numerous further advantages attend the invention.

DRAWINGS

The drawings form part of the specification hereof. In the drawings, which are not necessarily drawn to scale and in which like numerals refer to like features, the following is briefly noted:

FIG. 9 is a top view of an underlying base as depicted in FIG. 7 having a hitting/standing surface support thereon, with its hitting/standing surface removed.

ILLUSTRATIVE DETAIL

Figure 1:
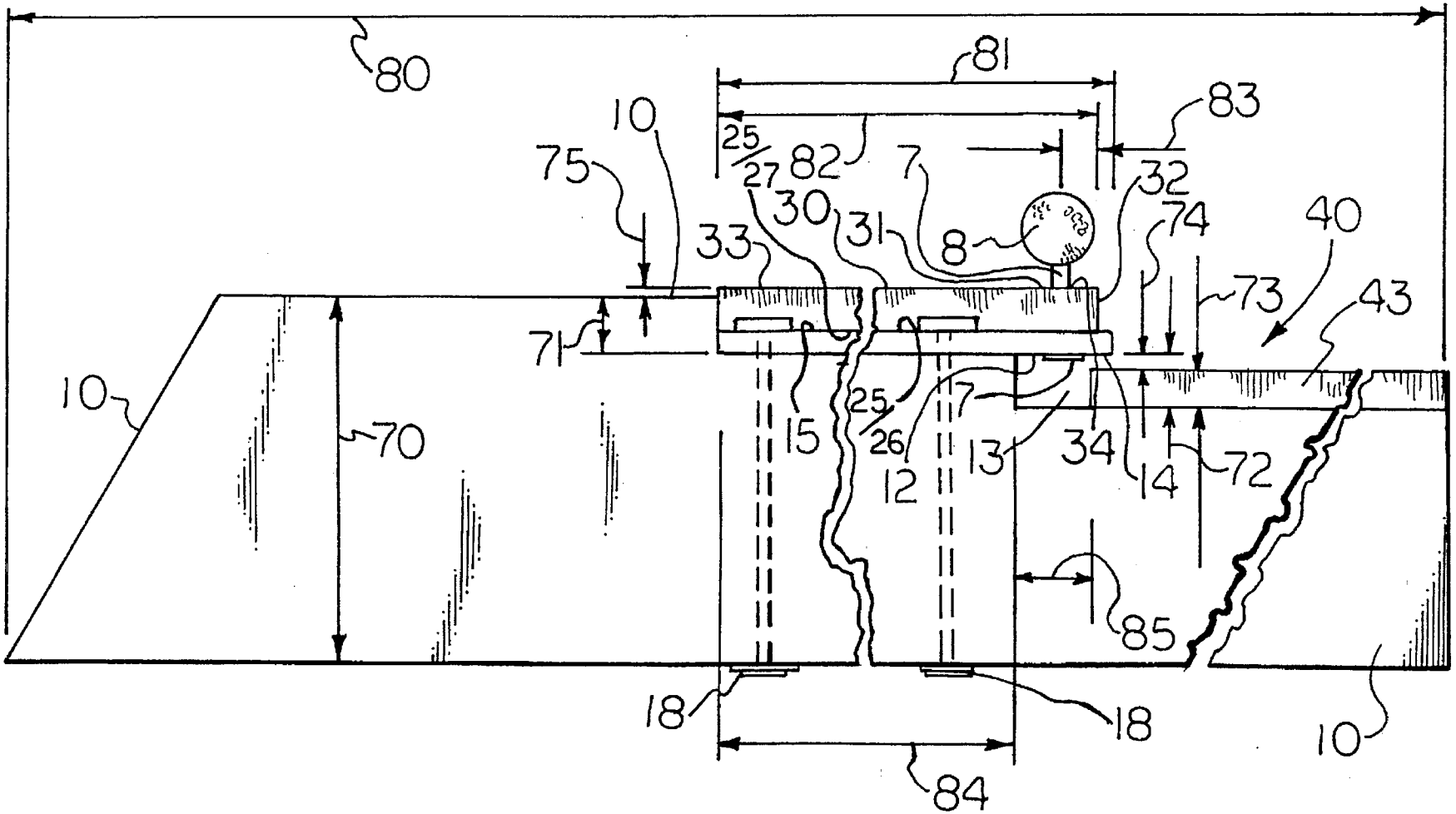
FIG. 1 is a side view of a golf swing training mat of the present invention.
Figure 2:
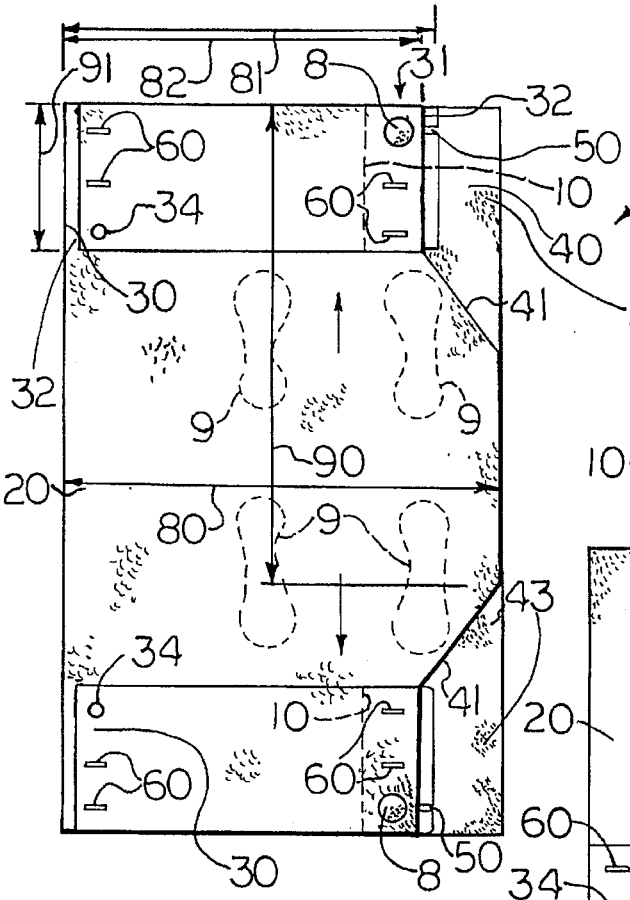
FIG. 2 is a top view of a mat as depicted in FIG. 1.
Figure 3:
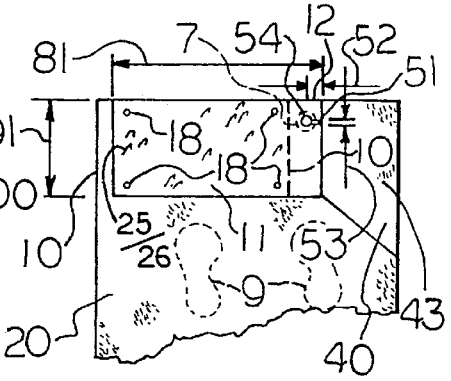
FIG. 3 is a top view of the mat of FIG. 2, with its hitting surface removed.
Figure 4:
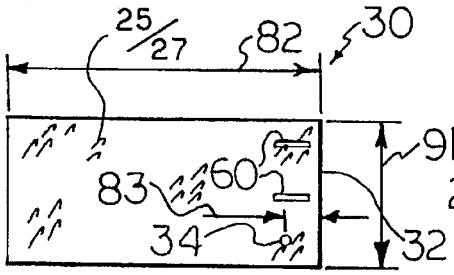
FIG. 4 is a bottom view of a hitting surface of the mat of FIG. 2.
Figure 5:
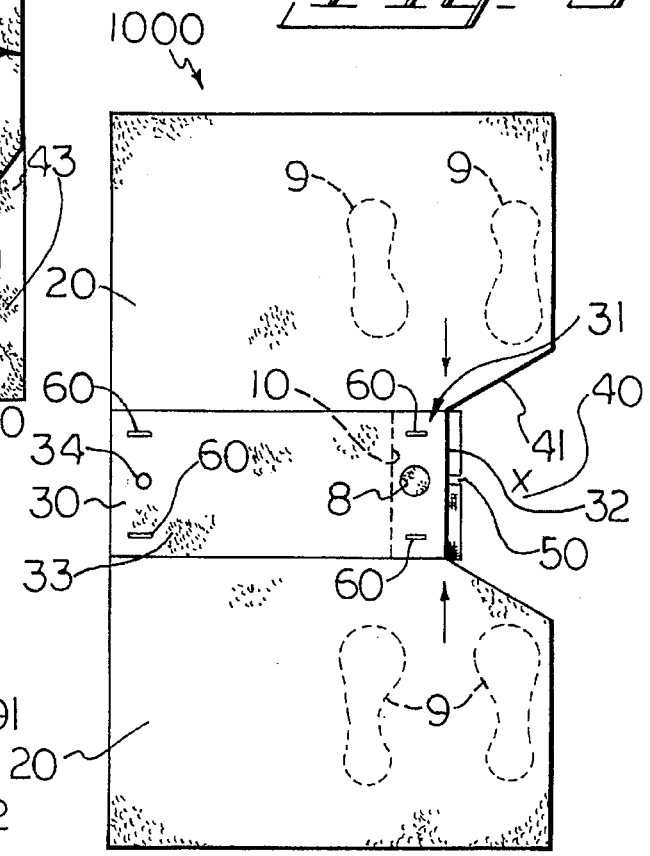
FIG. 5 is a top view of another embodiment of a golf swing training mat of the present invention.
Figure 6:
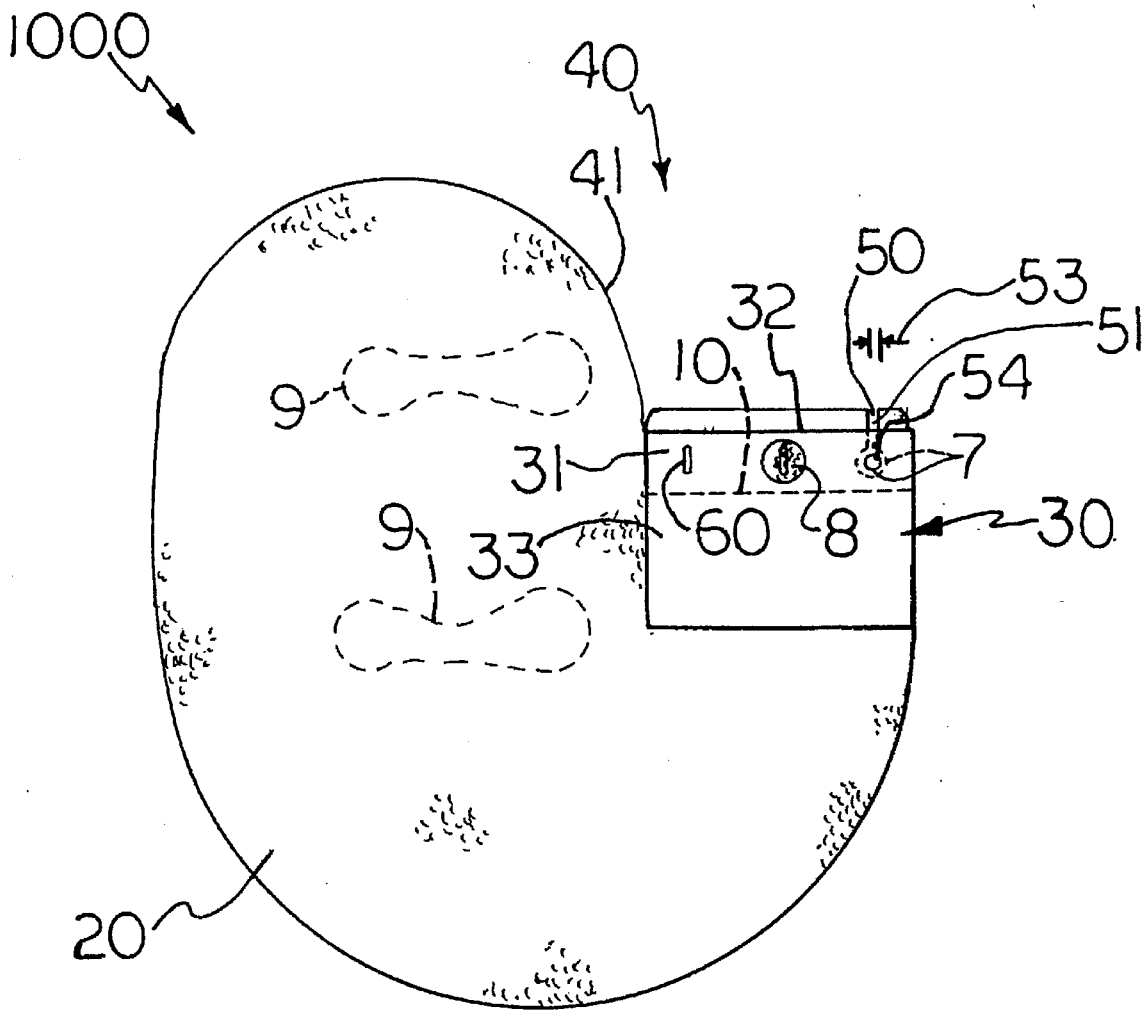
FIG. 6 is a top view of another embodiment of a golf swing training mat of the present invention.

The invention is further illustrated with the following detail, which generally may be taken in conjunction with the drawings, and is not to be construed as limiting in nature.

In reference to the drawings, and especially to FIGS. 1–6, golf swing training mat for highly authentic practice 1000 has support surface 10 or base, which may subtend standing surface 20. The support surface 10 subtends at least a part of hitting surface 30 when the hitting surface 30 is attached thereto.

The base 10, which may be a molded soft rubber material or the like, may have hitting surface support platform 11 with overhanging platform portion 12 which may define underpass 13. The platform 11 may be a material which can support a hitting surface 30 and yet be resilient upon the attached hitting surface 30 being struck with a golf club head, for example, ⅛-inch (0.32-cm) thick plastic such as a polyester, for example, a polyester-containing polymer, a polyurethane, a polycarbonate, a nylon or an engineering plastic. A polyolefin, for example, a polyethylene-containing polymer, may be employed. With the platform 11 and hitting surface front hitting area 31 above the empty underpass 13, an almost incredible perfection is achieved in golf swing realism when the iron shot is practiced. Such realism makes for excellent swing habit training, which can carry over onto the actual course. Exposed portion 14, for example, of an about ½-inch (1.3-cm) length and an about 12-inch (30-cm) width, although it may be covered with a means 25 for removably-attaching the hitting surface 30 thereto such as the loop portion 26 of VELCRO hook and loop material, may not be covered, at least initially before a series of golf club swings are attempted, with the hitting surface 30. The exposed portion is most advantageously present, especially when covered with means 25 such as loop portion 26, since its presence can allow the hitting surface 30 especially to include its front hitting area 31 and edge 32 to wear for extended periods of time, as in several months, often up to six months or more, without need of replacement. Without such an exposed portion 14, i.e., with front edge 32 and a platform 11 front boundary being coextensive, the hitting surface edge 32 wears noticeably. It is believed without wishing to be bound necessarily thereby that in the latter case, with each strike of the club, the hitting surface front hitting area 31 is moved forward slightly and the front edge 32 comes up momentarily to be struck by the iron especially as it "flaps," but in the former case when area 31 is moved forward from the iron, it finds further means 25 such as the loop 26 present in a supported platform extension 14 to bond with and be supported by so that the front edge 32 does not "flap" and be frayed by the club.

The means 25 for removably-attaching the hitting surface 30 to the base 10 such as the hook and loop material may be attached by sewing, gluing, hot-melt pressing of compatible materials and so forth and the like. Thus, the hook portion 27 of the hook and loop means 25 may be so attached to the underside of the hitting surface 30, and the loop portion 26 to the upper side of base platform 11, for example, by gluing with an epoxy glue.

The base platform 11 can be permanently attached to the base 10. For example, gluing and/or mechanical fasteners 18 such as rivets or bolt and nut combinations, say, with the mechanical fasteners 18 being employed about corners of a rectangular or square base platform 11.

The standing surface 20 may be part of the base 10 and of the same material, for example, of the rubbery materials, which may be flat or have a three-dimensional surface aspect such as by molding closely spaced posts or studs, or by providing ribs, and which may be made to be not slippery when wet. Alternatively, the standing surface 20 may be of a material different from the base and intended to provide the golfer with a more realistic footing such as artificial turf, sand-filled artificial turf, and so forth. Indicia for instruction may be employed on the mat or its standing surface. Preferably, the standing surface 20 is made to look like the hitting surface 30 even though it may be made of a different material such as one which can accommodate golf spikes.

The hitting surface 30 is separate from the standing surface 20 and removably attachable to the support surface 10 or at least a part of the support surface 10. The hitting surface 30 has an area thereof designated as a front hitting area 31. Preferably, the front hitting area 31 is present in conjunction with the overhang 12 as by being above and supported by it, and above the underpass 13 as well. A front edge 32 is present. The hitting surface 30 is made of a material that nearly looks and gives a feeling of real grass and that is not easily destroyed by repeated swings of a golf club striking the material, for example, a polyurethane or nylon artificial turf material, e.g., about 3⅜-inch (0.95-cm) thick ASTRO TURF grass type material 33.

A follow through notch or divot simulation area 40 is ahead of the hitting surface 30. The notch 40 is in part defined by an obliquely-angled edge 41 obliquely angled to and abutting the front edge 32 of the hitting surface 30. For example, the edge 41 may be linear as in FIGS. 2 & 5, or it may be curvilinear as in FIG. 6. The notch 40 envoids an area such that golfer 9 when swinging an iron can properly continue his swing naturally, downwardly after striking golf ball 8 with the iron into the downwardmost portion of the swing when the ball 8 is struck near the front hitting area 31 and allows for the golfer 9 to follow through in a practice swing without striking the obliquely-angled edge 41. In the follow through notch 40 or divot area may be placed, for example, as by gluing and/or mechanical fastening, divot area surface 43, which may be, for example, artificial turf, say, about ⅜-inch (0.95-cm) thick ASTRO TURF grass type material glued on top of part of the base 10 Which may be low in the follow through notch 40. However, the club generally never strikes the artificial turf grass in the divot area 40. In the divot area 40, an "X" marks the spot as in FIG. 5, about where golfing target indicia such as a white dot and so on may be placed for instruction.

Tongue with tee slot 50 may be an article apart or be with a practice mat, generally in subsurface position at the front edge of the hitting area 31 as in the present mat 1000. Such an article is useful for golf swing training and can be made in general of a durable material such as a polyester, polyurethane, polyacetate, nylon, and so forth plastic. A polyolefin may be employed. The slot 50 can be a cul-de-sac shaped notch generally defined by neck 51 having length 52 and width 53 and wider diameter hole 54. The tee slot 50 can accommodate the positioning of a virtually indestructible rubber practice tee 7 having a base and a post as is well known in the art by slipping the post of the tee sidewardly through the neck 51 from outside the tongue such that the post of the tee 7 can rest in the larger hole 54 with the base of the tee 7 under the tongue or base platform 11. A golf ball 8 can be teed up on the post of the tee 7. Alone, the tongue and tee slot article may be fastened onto the ground as by nailing or spiking it into the ground, or pad or other surface, especially so that the neck 51 of the slot or notch 50 opening is exposed for insertion of the tee 7, and the tongue may be lifted up for replacement of a tee. When the tongue is attachable to an underside of a hitting surface, for example, being part of base platform 11 in the mat 1000, part of the notch 50 is exposed and not covered by the hitting surface material, and the neck 51 of the notch 50 opens outwardly from the hitting surface, but the remaining part of the notch in its neck 51 especially is covered by a removably attachable hitting surface 30. Typically therein, a hole 34 is cut into the hitting surface 30 to be in registry with the hole 54 when the hitting surface 30 is attached to the base platform 11. Advantageously, holes 34 & 54 provide a snug fit for the post of the tee 7, and thus, with each hit of the driver or other club at the teed-up ball 8, the tee may be kept in an elevated position. The snug fit is not so constricting that the golfer 9 cannot tee up a new ball and lower the tee 7 as for a 3-wood shot. The tongue with its tee slot or notch 50 may be removably attachable to the underside of the hitting surface by means of the hook and loop materials, for example, the VELCRO hook and loop materials. One or more sets of holes 34 and/or 54 may be in a mat, including in the base platform 11 and hitting surface 30 of the mat 1000. Such characteristic as of a preferred mat 1000, with tee slot 50 and snug-fitting holes 34 & 54, to provide the ability to vary the height of a tee is a very big breakthrough in golf mats. Accordingly, the driver to fairway wood practice is greatly eased, and the practice is generally not unduly interrupted to adjust tees when changing clubs.

One or more turf slots 60 may be provided. Such may be provided in any suitable material, mat or pad for golf swing training, but is desirably employed in a mat of the invention such as the mat 1000. Accordingly, in general, an article useful for golf swing training is provided, which includes a hitting surface, made of a material that nearly looks and gives a feeling of real grass and that is not easily destroyed by repeated swings of a golf club striking the material, with a turf slot therein. The turf slot 60, for example, about 1-inch by ⅜-inch (2.5-cm ×0.95-cm) through a hitting surface 30 of artificial turf and even through the back, but if present in the back typically of a narrower width thereat, can accommodate golf ball 8. This provides for a very realistic lie in that in actual play the ball never lies high on top of the grass but slightly into it, as the mat 1000 effectively imitates. Also, it keeps the ball 8 from rolling on the hitting surface 30 and encourages the golfer 9 to hit from the slot 60, which preferably is in a front hitting area 31 of the hitting surface 30. Thus, the maximum benefit of the mat can be obtained.

The golf swing practice mat of the invention may be made for use by one or more golfers and be of any suitable shape. See, e.g., FIGS. 2, 5 & 6. It may be made so as to be sold to and/or used by right and left handed individuals. See, e.g., FIGS. 2 & 5. It may range in size from relatively small as, for example, with a mat 1000 dominated in size by its hitting surface, to relatively large. As an example, the mat 1000 as in FIGS. 1–4 may include features with the following dimensions, which may be considered approximate:

| Feature | Dimension |
|---|---|
| 11 | ⅛-inch (0.32-cm) thickness. |
| 34 | ⅝-inch (1.6-cm) diameter. |
| 52 | 1-7/16 inches (3.7 cm). |
| 53 | 3/16 inch (0.48 cm). |
| 54 | ⅝-inch (1.6-cm) diameter. |

In addition, the following distances may be found therein:

| Identity | Distance |
|---|---|
| 70 | 1-½ inches (3.8 cm). |
| 71 | ⅜ inch (0.95 cm). |
| 72 | ⅝ inch (1.6 cm). |
| 73 | ½ inch (1.3 cm). |
| 74 | ⅛ inch (0.32 cm). |
| 75 | ¼ inch (0.64 cm). |
| 80 | 42 inches (1.1 m). |
| 81 | 29 inches (74 cm). |
| 82 | 28-½ inches (72 cm). |

-continued

| Identity | Distance |
|---|---|
| 83 | 1-¾ inches (4.4 cm). |
| 84 | 26 inches (66 cm). |
| 85 | 2-½ inches (6.4 cm). |
| 90 | 60 inches (1.5 m). |
| 91 | 12 inches (30 cm). |

In further reference to the drawings, and especially to FIGS. 7–11, mat 1100 (FIGS. 10 & 11) has base 110, which generally subtends hitting/standing-support surface 120 and/or hitting/standing surface 130. The support surface 120 may be present and generally subtend at least a part of the hitting/standing surface 130 when the surface 130 is attached with the mat 1100.

The base 110, which may be of generally any material, and thus, may include relatively hard items such as wood, hard rubber, rubber products from recycle of used automobile tires, or may be of a molded soft rubber material, or the like. The base material need not be soft to provide for highly authentic golf swing practice, including most notably with iron strokes where a "divot" is to be taken after striking golf ball 8, and this is owing at least in part to the configuration of the base to provide openings 111 & 112, for a mat including a platform open on one side and supported on remaining sides, or other such designs as circular, oval, square, or other-shapes unsupported by base material support surface 110 notably about hitting surface 130/133 forward area 131. See, FIGS. 7–10 & 11. Accordingly, a wider range of more readily available, more inexpensive, and even more durable base materials can be employed.

As depicted in FIGS. 7–10, the base 110 may be of a plurality of pieces. The pieces, which may include standing area base pieces 113 and hitting area base pieces 114, may interlock by means of a tab 115 and recess 116 arrangement. A hitting area base piece 114 can have symmetrically arranged tabs 115 and recesses 116 for interlocking with either left or right hand side of standing area base pieces 113, or for the ability to be turned around and placed back in the same side of a hitting area base piece 113.

Figure 11:
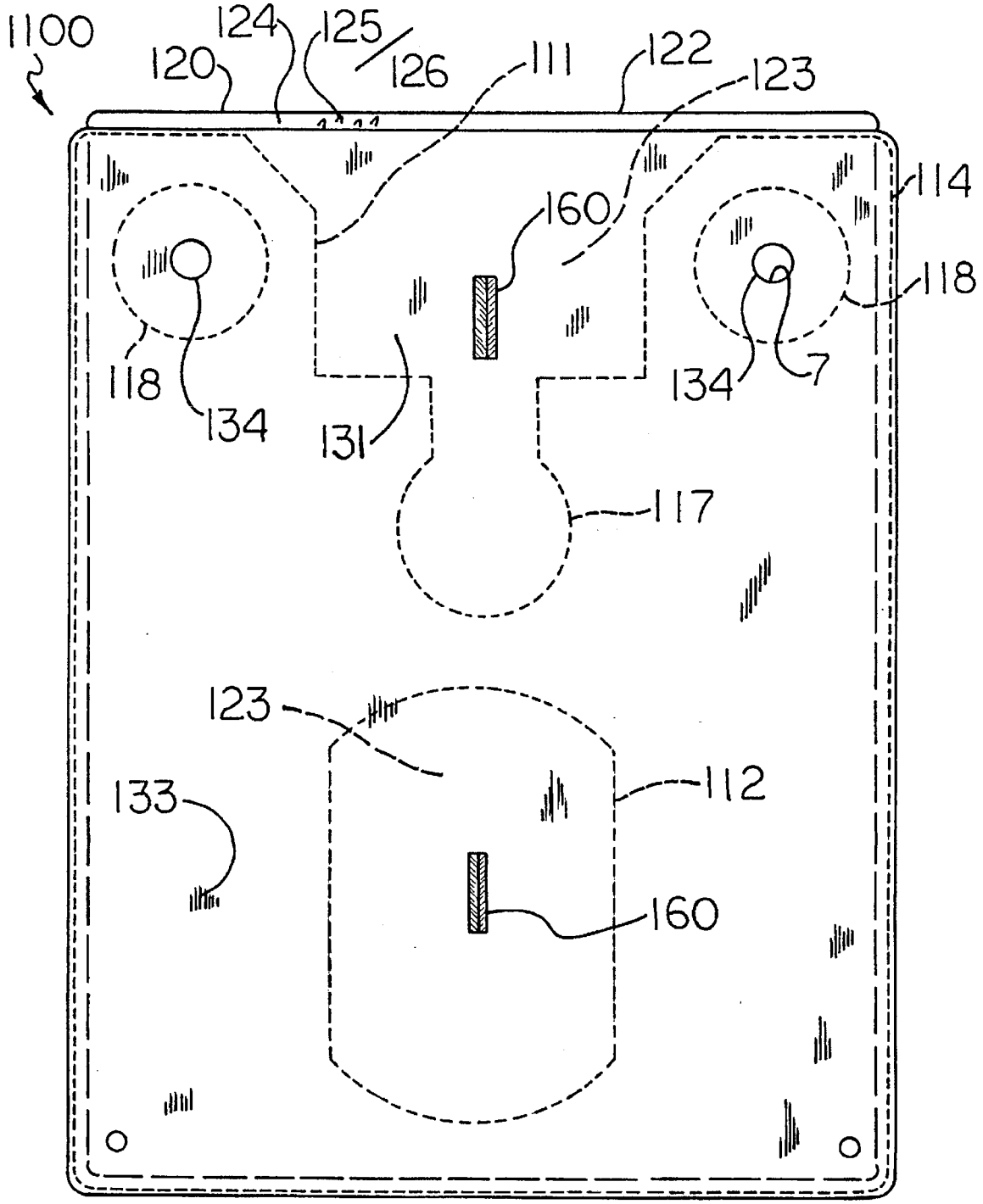
FIG. 11 is a top view of another embodiment of the invention.

As depicted in FIG. 11, the base 110 may be of one piece. Such a mat may be large enough to stand on, or be smaller so that the base is essentially a hitting area base piece 114.

Accordingly, the base 110 may be made to be readily portable or shippable. Yet, the base 110 when assembled can be strong. It, too, may be attached together, for example, glued, stapled, screwed, etc., together on-site, if desired.

In addition, as depicted in FIGS. 7–10 & 11, another opening 117 may be provided rearward of the openings 111 & 112 such as would be in position behind a golf ball placed on the mat 1100 in hitting position for an iron shot, as in turf slot 160. Such an opening 117 may help provide for a nearly incredible realism in golf swing training as, with the same, when the club, in particular an iron, strikes behind the ball, the mat gives much like natural turf does when struck. Rearward opening 117 and forward part of underpass 123 combined may provide a Y-shaped boundary underpass 123.

Also, as depicted in FIGS. 7–10 & 11, holes 118 for accommodating the base of a standard rubber tee 7 can be provided in the base 110, and in particular, in its hitting area base piece 114. The holes 118 may have 2½-inch (6.3-cm) diameters.

The base may be of any suitable dimensions. Thickness of the base may vary accordingly, for instance, being about from ¼, ⅜ or ½ of an inch (0.64, 0.95 or 1.3 cm) to an inch (2.5 cm) or more. A low profile mat 1100, however, is a preferred embodiment, and an overall mat 1100 profile of about ½ to ¾ of an inch (1.3 to 1.9 cm) is possible.

The support surface 120 cab be of any material which can underlie standing surface 135 or support hitting surface 133 such as in the form of a hitting surface support platform 121 with overhanging platform portion 122 which may define underpass 123, for example, having a generally U-shaped boundary, excluding 117. The surface may be part of or backing to a turf-like material used as a hitting/standing surface 130. The surface 120 may be a material which can support the hitting surface 133 and yet be resilient upon the attached hitting surface 133 being struck with a golf club head, for example, ⅛-inch (0.32-cm) thick plastic such as a polyester, for example, a polyester-containing polymer, a polyurethane, a polycarbonate, a nylon or another engineering plastic. A polyolefin or polyolefin-containing polymer may be employed.

Accordingly, an almost incredible perfection is achieved in golf swing realism when the iron shot is practiced. Such realism makes for excellent swing habit training, which can carry over onto the actual course. Exposed portion 124, for example, of an about ½-inch (1.3-cm) length and an about 12-inch (30-cm) width, although it may be covered with a means 125 for removably-attaching the hitting surface 130 thereto such as the loop portion 126 of a hook and loop material, e.g., VELCRO material, may not be covered, at least initially before a series of golf club swings are attempted, with the hitting surface 133. The exposed portion 124, especially when covered with means 125 such as loop portion 126, can allow the hitting surface 133 especially to include its front hitting area and edge to wear for extended periods of time, without need of replacement.

The means 125 for removably-attaching the surface 130 to the support 120 such as the hook and loop material may be attached by sewing, gluing, hot-melt pressing of compatible materials and so forth and the like. Thus, the hook portion of the hook and loop means 125 may be so attached to the underside of the surface 130, and the loop portion 126 to the upper side of the support 120, for example, by gluing with an epoxy glue.

The support surface 120 can be permanently attached to the base 110. For example, gluing and/or mechanical fasteners such as rivets or bolt and nut combinations, say, with the mechanical fasteners employed about corners of a trapezoidal, rectangular or square arrangement or piece thereof. As an alternative, the support surface 120 may be removably attached to the base 110 such as by suitable attachment of hook and loop fastener materials on the top of the base 110 and the bottom of the support surface 120.

The support surface 120 may be provided in pieces. For example, a number of pieces 127 may be provided for placement over the standing, and one piece 128 over each hitting, areas.

Holes 229 can be provided in the piece 128 to accommodate the post of the standard rubber tee 7. For example, the holes 129 may have 21/32-inch (1.67-cm) diameters.

Preferably, the standing surface 135 is made to look like the hitting surface 133 even though it may be made of a different material such as one which can accommodate golf spikes. As well, indicia for instruction may be employed on the mat 1100 or its hitting/standing surface 130.

Generally, as depicted in FIGS. 7–10, the hitting surface 133 is separate from the standing surface 135, and each of the types of the surfaces 130 may be removably attachable to its underlying support surface 120 or at least a part of the support surface 120. Generally, the hitting surface 133 is made of a material that nearly looks and gives a feeling of real grass and that is not easily destroyed by repeated swings of a golf club striking the material, for example, a polyurethane or nylon artificial turf material, e.g., about ⅜-inch (0.95-cm) thick ASTRO TURF grass type material.

Holes or slots 134 may be present in the hitting surface 133 to accommodate the post of the standard rubber tee 7. A slot 134, for example, may be about an inch long with 21/32-inch (1.67-cm) radii at opposing ends thereof along an axis of the expected direction of flight of a golf ball 8 to be struck off the tee 7. The tee 7 can be inserted by lifting the outside edge of the mat 1100 and pushing the tee 7 through openings 129 & 134.

The holes 118, 129 & 134 can provide for a most effective means of adjustment of the height of the rubber practice tee 7. Simply by turning and pulling up or pushing down on the post of the tee 7, can the tee be raised or lowered to the desired height for driver and wood shot practice. Accordingly, the problem of cut-off practice tees on driving ranges can be ameliorated or overcome. Such an arrangement improves upon the cul-de-sac 50.

Figure 10:
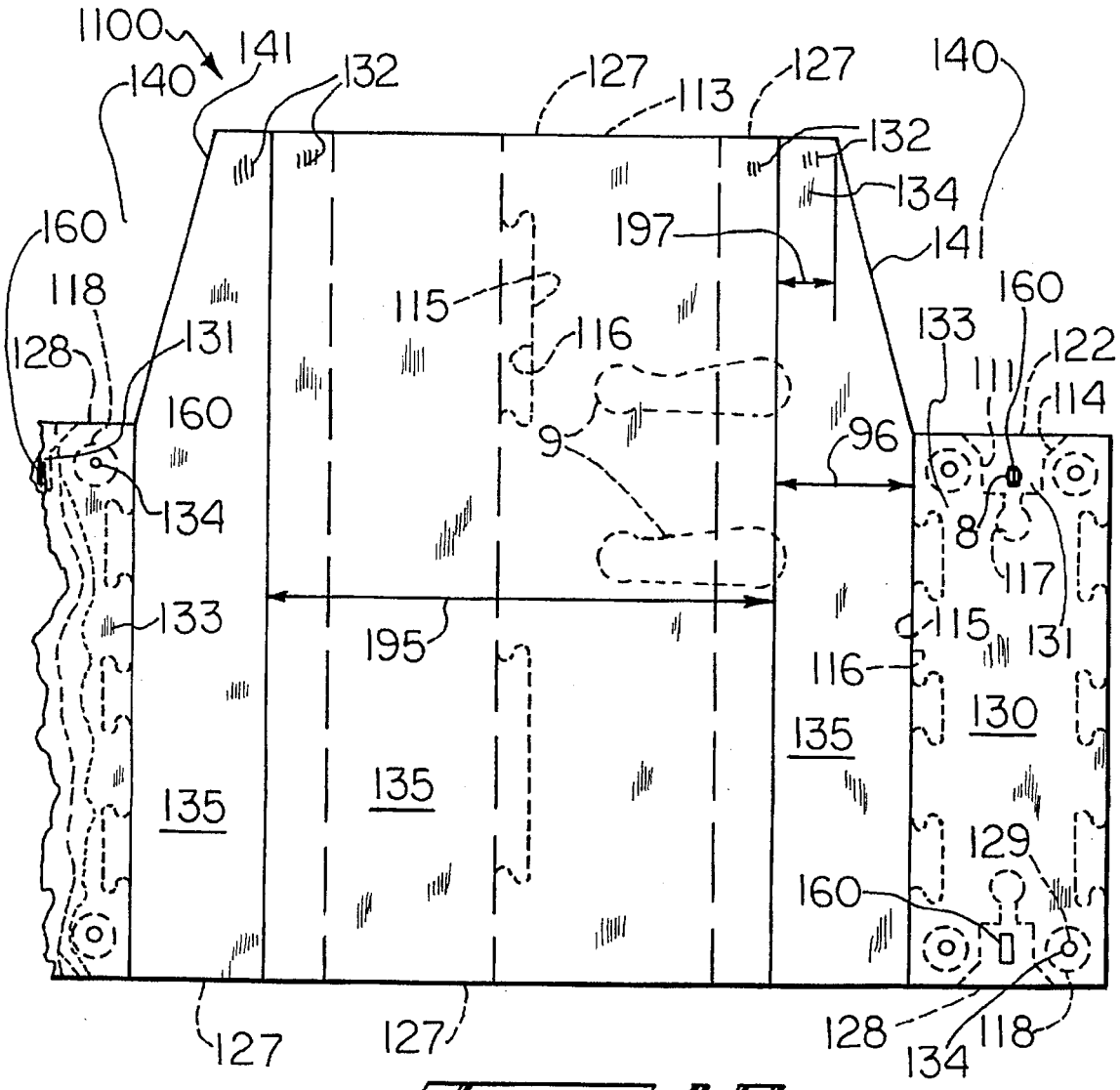
FIG. 10 is a top view of the mat having a base and hitting/standing surface support as of FIGS. 7 & 9 with a hitting/standing surface thereon.

As depicted in FIG. 10, the surfaces 130 may be provided in more than one piece, to include providing the standing surface in a plurality of pieces 132, and each hitting surface 133 being separate. This can accommodate different wear characteristics which a mat 1100 may engender in use.

Figure 7:
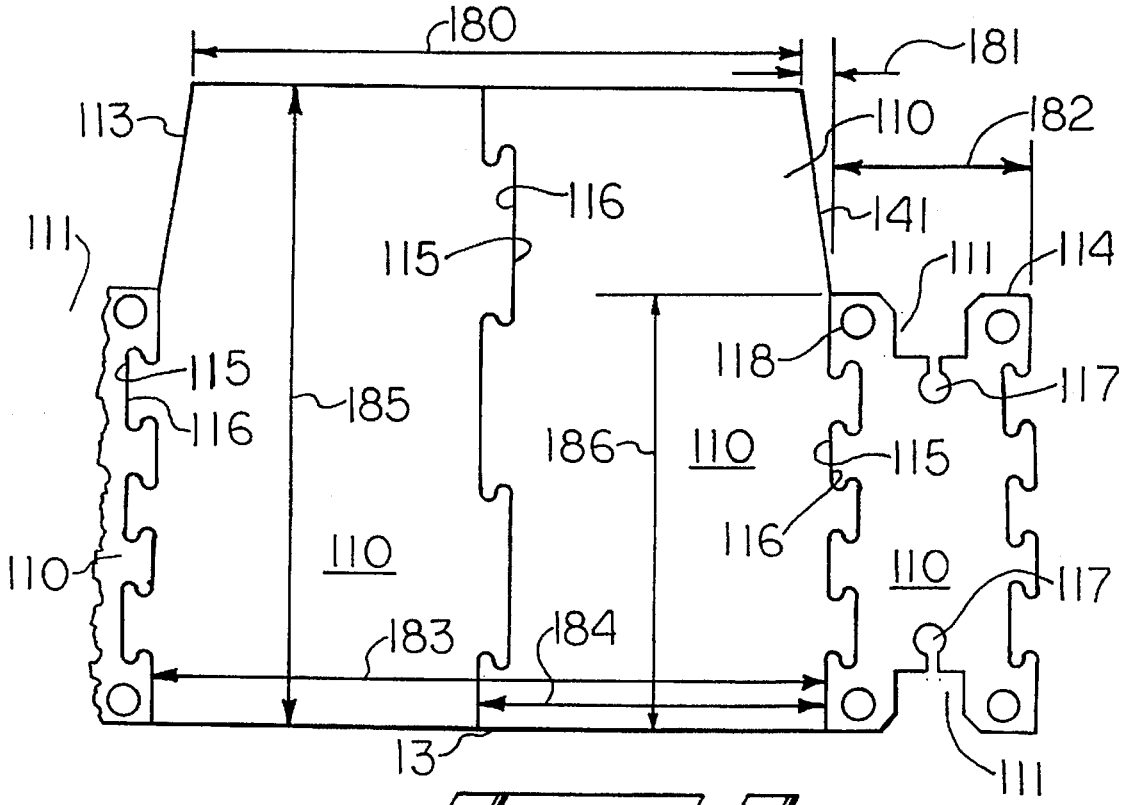
FIG. 7 is a top view of an interlocking multi-piece base of another embodiment of the present invention.
Figure 8:
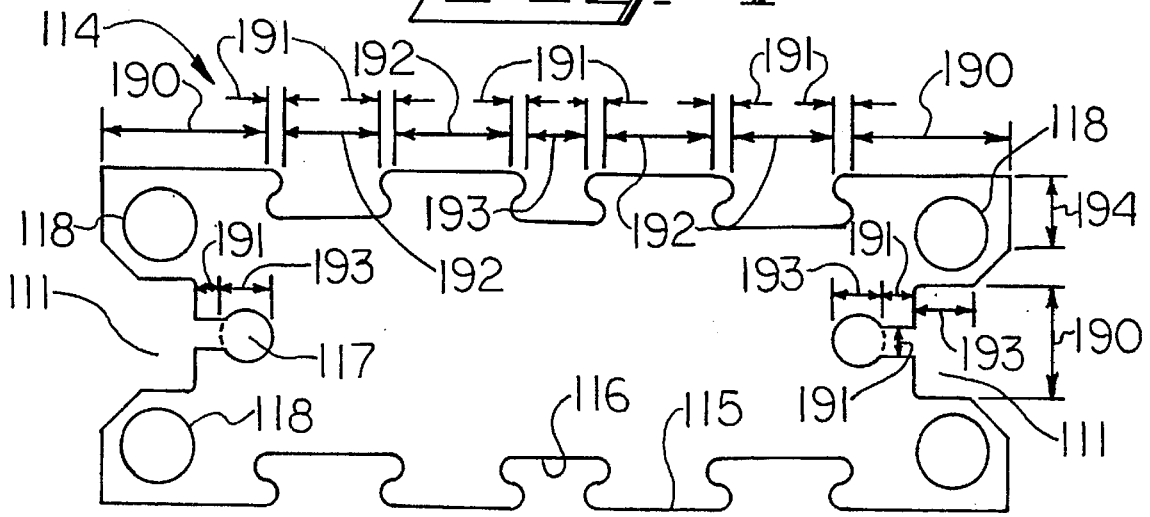
FIG. 8 is a top view of a hitting area base part as depicted in FIG. 7.
Figure 4:
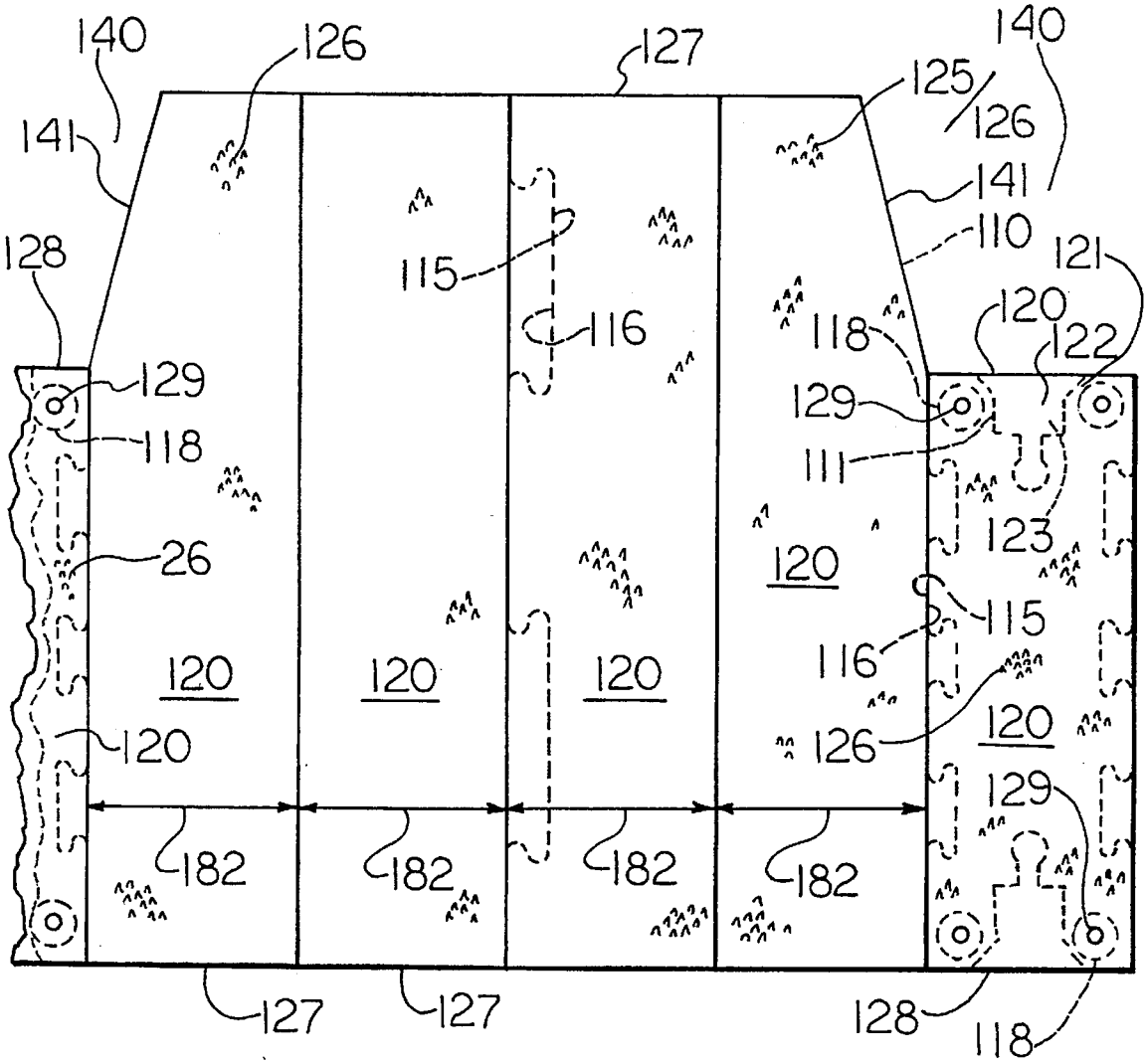

As depicted in FIGS. 7, 9 & 10, a follow through notch or divot simulation area 140 may be ahead of the hitting surface 133. The notch 140 is in part defined by an obliquely-angled edge 141 obliquely angled to and abutting a front edge of the hitting surface 133. For example, the edge 141 may be linear as in FIGS. 7, 9 & 10, or it may be curvilinear. The notch 140 envoids an area such that a golfer when swinging an iron can properly continue his swing naturally, downwardly after striking golf ball 8 with the iron into the downwardmost portion of the swing when the ball 8 is struck near the front hitting area 131 and allows for the golfer to follow through in a practice swing without striking the obliquely-angled edge 141.

As with the turf slot 60 which may appear in conjunction with the mat 1000, one or more turf slots 160 may be and desirably is or are provided, generally above the underpass 123 in the forward area 131 of the hitting surface 133 of the mat 1100. The turf slot 160 can be of the same construction and dimensions, for example, and serve the same function, as the turf slot 60.

The golf swing practice mat 1100 may be made for use by one or more left and/or right handed golfers and be of any suitable shape. It may range from relatively small as may be the case with a mat dominated in size by its hitting surface (FIG. 11) to relatively large in size. For an example, the mat 1100 as in FIGS. 7–10 may include features with the following dimensions:

| Feature | Dimension |
|---|---|
| 180 | 38 inches (97 cm). |
| 181 | 4 inches (10 cm). |
| 182 | 11-½ inches (29.2 cm). |
| 183 | 46 inches (117 cm). |
| 184 | 23 inches (58 cm). |
| 185 | 43 inches (109 cm). |
| 186 | 29 inches (74 cm). |
| 190 | 4-½ inches (11.4 cm). |
| 191 | 1 inch (2.5 cm). |
| 192 | 3 inches (7.6 cm). |
| 193 | 2 inches (5 cm). |
| 194 | 2-½ inches (6.4 cm). |
| 195 | 30 inches (76 cm). |
| 196 | 8 inches (20 cm). |
| 197 | 4 inches (10 cm). |

Such dimensions may be considered to be approximate.

In further reference to the drawings, and especially to FIGS. 12–16, most preferred mat 1200 (FIG. 15) has base 210, which generally subtends hitting/standing-support surface 220. The support surface 220 subtends hitting/standing surface 230 when the surface 230 is attached with the mat 1200.

The base 210 of the mat 1200 is preferably made of a molded rubbery material or the like. For instance, the base 210 may be heat molded from recycled rubber stock.

Provided is an opening 211 for a generally U-shaped boundary underpass 223 unsupported by base material support surface 270, particularly about hitting surface 230/233 forward area 231. See, FIGS. 12–16.

As depicted in FIGS. 12–16, the base 210 of the mat 1200 is made of a plurality of pieces. The pieces, which may include standing area base pieces 213 and hitting area base pieces 214, interlock by means of a tab 215 and recess 216 arrangement. In the preferred arrangement, a predominance of "male" tabs 215 is present with one-piece hitting 210 and divot 240 area part 270, which tabs and corresponding recesses 216 are smaller than the aforementioned tabs 15 & 115 and recesses 16 & 116 so as to increase the capability of the hitting surface 230 to remain in place when a ball 8 is struck off the hitting surface turf 233. The weight of a golfer 9 standing on the standing area 235 as supported by support pieces 220 creates enough downward pressure on the support piece 220/227 covering the recesses 216 in the standing area 213 of the base 210 which connect with the tabs 215 of the hitting area 214 of the base 210 to hold these pieces down and in place. The hitting area base piece 214 has symmetrically arranged tabs 215 and recesses 216 for interlocking with either left or right hand side of standing area base pieces 213. Thus formable are various configurations such as may be found not only in FIGS. 15 & 16 but also as would correspond to FIG. 5, etc.

The one-piece hitting and divot area base 270 of the mat 1200 alleviates the inconvenience that a golf driving range operator has of having to keep up with replacement of two separate pieces for hitting and divot bases, which can be engendered by practice of the prior mat of the Durso patent, or even of this invention with the mat 1000 or 1100, and it insures certain attachment of the hitting area base 214 part with the divot area base 240 part. The base part 270 can be made in a bilevel mold of the aforesaid rubber. See, FIGS. 12–13. Note, the ridge 219 defining the base hitting area 214 vs. base divot area 240 and downstroke hitting opening 211 of the base 210. This also reduces manufacturing costs and speeds up the manufacturing process of the mat 1200.

Accordingly, the base 210 may be made to be readily portable or shippable. Yet, the base 210 when assembled is strong in the mat 1200.

Figure 12:
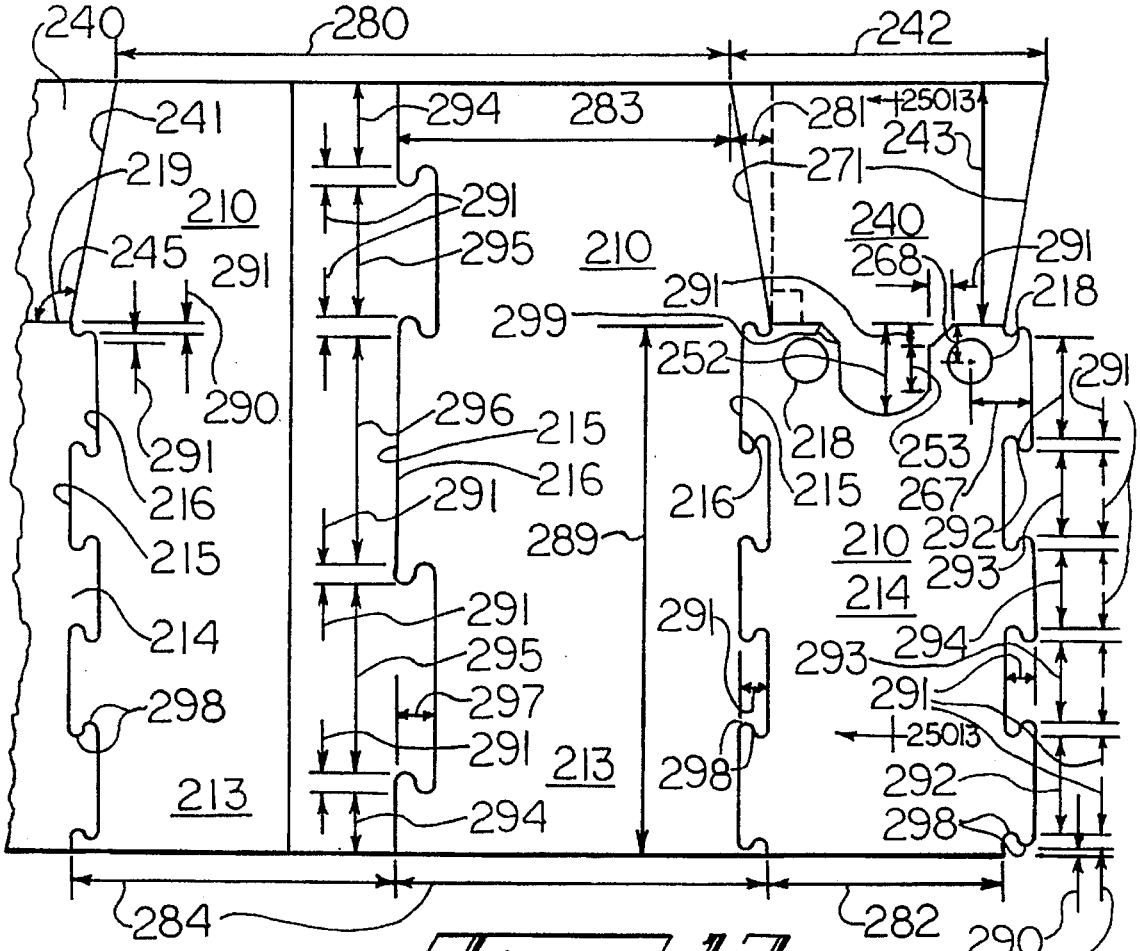
FIG. 12 is a top view of another interlocking multi-piece base of yet another embodiment of the present invention.
Figure 13:
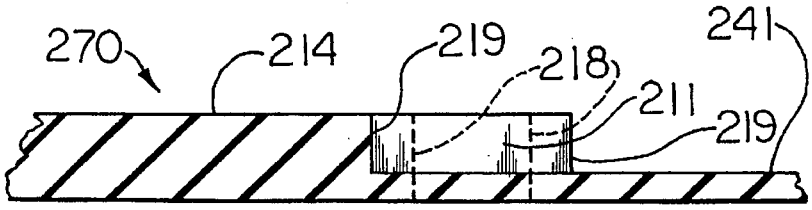
FIG. 13 is a cut-away view of part of the one-piece hitting and divot area base, taken along the line 25013—25013 (FIG. 12).
Figure 14:
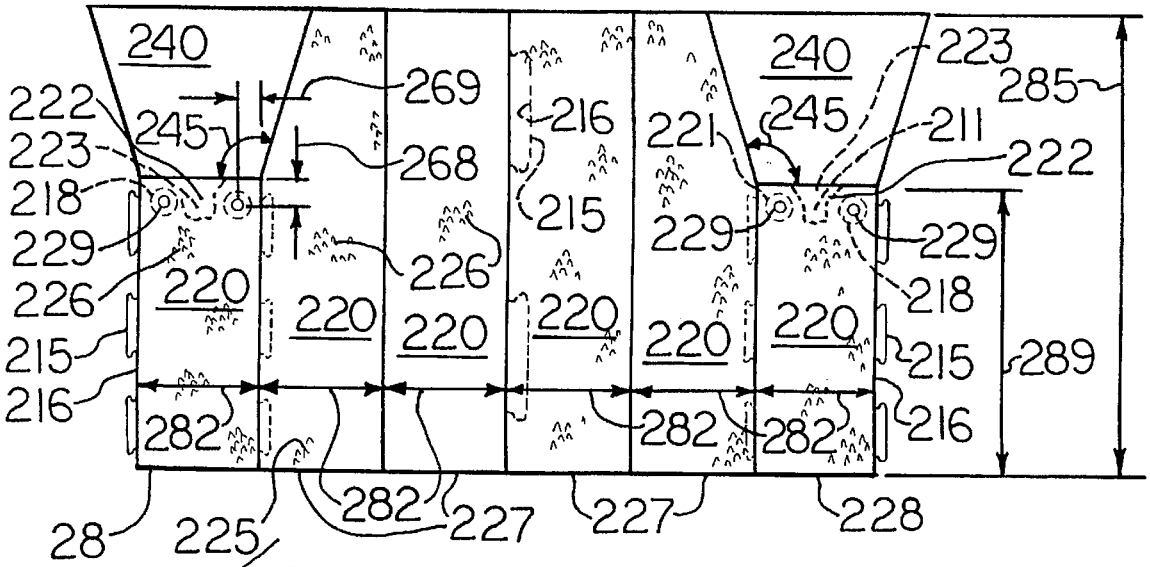
FIG. 14 is a top view of an underlying base as depicted in FIG. 12 having a hitting/standing surface support thereon, with its hitting/standing surface removed.
Figure 16:
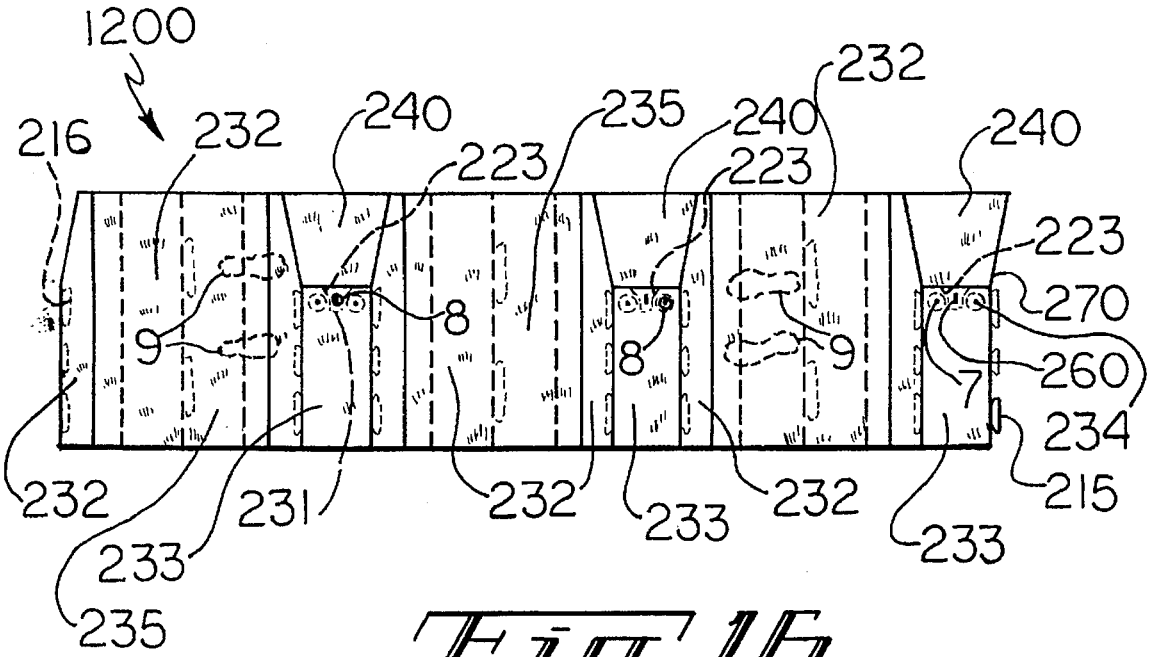
FIG. 16 is a top view of the mat of the invention, as for example from FIG. 15, connected in an extended array.

As depicted in FIGS. 12 & 114–16, holes 218 for accommodating the base of a standard rubber tee 7 can be provided in the base 210, and in particular, in its hitting area base piece 214. The holes 218 preferably have 2½-inch (6.3-cm) diameters.

The base 210 may be of any suitable dimensions. Thickness of the base 210 may vary accordingly, and may be, for instance, from about ¾ of an inch (1.9 cm) to about an inch (2.5 cm) for base parts 213 & 214 and about ⅛ to ¼ of an inch (0.32 to 0.64 cm) for base divot area part 240.

The support surface 220 is of any material which underlies standing surface 235 or support hitting surface 233 such as in a form of a hitting surface support platform 221 with overhanging platform portion 222 which defines underpass 223. The surface may be part of or backing to a turf-like material used as a hitting/standing surface 230. The surface 220 is a material which can support the hitting surface 233 and yet be resilient upon the attached hitting surface 233 being struck with a golf club head, for example, ⅛-inch (0.32-cm) thick plastic such as made of a polyester, for example, a polyester-containing polymer.

Accordingly, an almost incredible perfection is achieved in golf swing realism when the iron shot is practiced. Such realism makes for excellent swing habit training, which can carry over onto the actual course. An exposed edge portion is not necessarily employed with the mat 1200.

The means 225 for removably-attaching the surface 230 to the support 220 such as the hook and loop material may be attached by sewing, gluing, hot-melt pressing of compatible materials and so forth and the like. In the mat 1200, the hook portion of the hook and loop means 225 is attached to the underside of the surface 230, and the loop portion 226 to the upper side of the support 220, for example, by gluing with an epoxy glue.

Typically, the support surface 220 is permanently attached to the base 210. For example, gluing and/or mechanical fasteners such as rivets or bolt and nut combinations, e.g., with the mechanical fasteners employed about vertices.

The support surface 220 is provided in pieces. Pieces 227 & 228 are provided for placement over the standing and hitting areas 213 & 214, respectively.

Holes 229 with 21/32-inch (1.67-cm) diameters are provided in piece 228 to accommodate the post of the standard rubber tee 7.

Preferably, the standing surface 235 is made to look like the hitting surface 233 even though it may be made of a different material such as one which can accommodate golf spikes. As well, indicia for instruction may be employed on the mat 1200 or its hitting/standing surface 230.

The standing and hitting surfaces 235 & 233 are separate from one another in the mat 1200, and each of these surfaces 230 is removably attachable to its underlying support surface 220. The hitting surface 233 is made of a material that nearly looks and gives a feeling of real grass and that is not easily destroyed by repeated swings of a golf club striking it, for example, a polyurethane or nylon artificial turf material, e.g., about ⅜-inch (0.95-cm) thick ASTRO TURF grass type material.

Slots 234 are present in the hitting surface 233 to accommodate the post of the standard rubber tee 7. The slot 234, like exemplary slot 134 of mat 1100, has a 21/32-inch (1.67-cm) radii at opposing ends thereof along an axis in the expected direction of flight of a golf ball 8 to be struck off the tee 7. If the base is one inch (2.5 cm) thick, then the amount of travel of the tee 7 is approximately ¾ of an inch (1.9 cm) vertically. The tee 7 can be inserted by lifting the outside edge of the mat 1200 and pushing the tee 7 through hole 229 and slot 234.

The system of holes 218, 229 & 234 provide a most effective means of adjustment of the height of the rubber practice tee 7. Again, the tee 7 can be raised and lowered simply by turning and pulling up or pushing down on the post of the tee 7.

Figure 15:
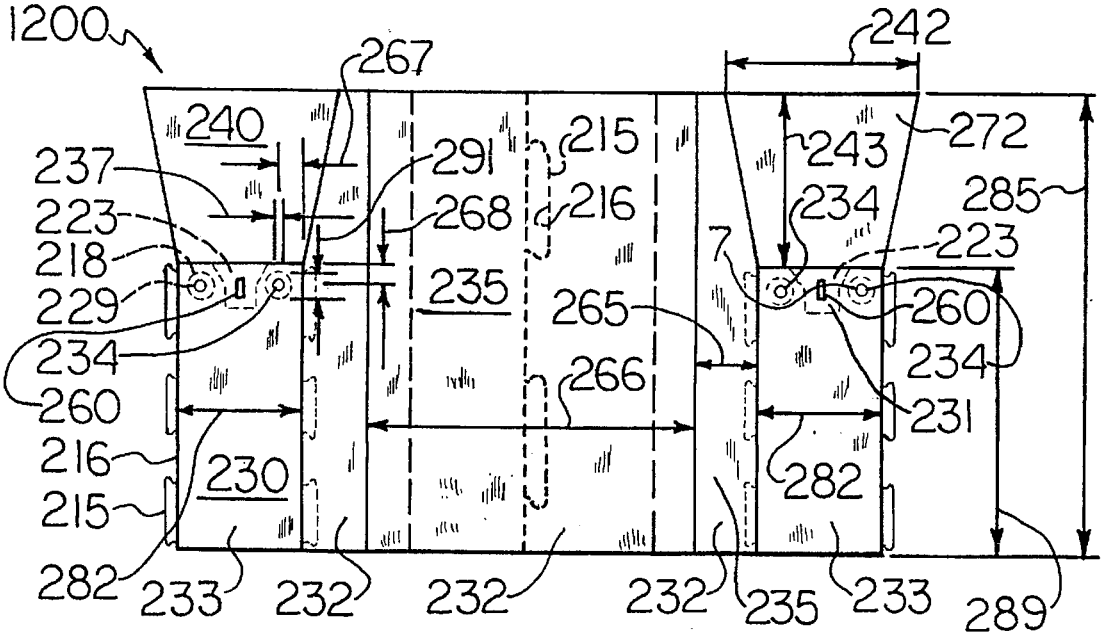
FIG. 15 is a top view of the mat having a base and hitting/standing surface support as of FIGS. 12 & 14 with a hitting/standing surface thereon.

As depicted in FIGS. 15 & 16, the surfaces 230 are provided in more than one piece. The standing surface 235 is present in a plurality of pieces 232. Each hitting surface 233 is separate. This accommodates different wear characteristics which a mat 1200 may engender in use.

As depicted in FIGS. 12 & 14–16, a follow through notch or divot simulation area 240 is ahead of the hitting surface 233. The notch 240 is in part defined by an obliquely-angled edge 241 abutting a front edge of hitting surface 232. Obliquely-angled edge 271 of the one-piece hitting and divot area surface 270 corresponds thereto. The divot area 240, which has the same function as divot areas 40 & 140, is preferably made to have its base portion covered with a rugged artificial turf 272.

In general, as with the turf slot 60 which may appear in conjunction with the mat 1000, and turf slot 160 in the mat 1100, a turf slots 260 is preferably provided above the underpass 223 in the forward area 231 of the hitting surface 233 of the mat 1200. Typically, the turf slot 260 is of the same construction and dimensions, for example, and serves the same function, as the turf slots 60 & 160.

The golf swing practice mat 1200 may be made for use by one or more left and/or right handed golfers and be of any suitable shape and size. For example, the mat 1200 may include features with the following additional dimensions (FIGS. 12 & 14–16):

| Feature | Dimension |
|---|---|
| 237 | 21/32 inch (1.67 cm). |
| 242 | 20-½ inches (52 cm). |
| 243 | 17 inches (43 cm). |
| 244 | 15-degree angle. |
| 245 | 105-degree angle. |
| 252 | 3-½ inches (8.9 cm). |
| 253 | 2 inches (5 cm). |
| 254 | 2-1/2 inches (6.4 cm). |
| 265 | 8 inches (20 cm). |
| 266 | 30 inches (76 cm). |
| 267 | 2-¾ inches (7.0 cm). |
| 268 | 1-11/16 inches (4.29 cm). |
| 269 | 1-¾ inches (4.4 cm). |
| 280 | 37 inches (94 cm). |
| 281 | 4-½ inches (11.4 cm). |
| 282 | 11-½ inches (29.2 cm). |
| 283 | 18-½ inches (47 cm). |
| 284 | 23 inches (58 cm). |
| 285 | 44 inches (112 cm). |
| 289 | 27 inches (69 cm). |
| 290 | ½ inch (1.3 cm). |
| 291 | 1 inch (2.5 cm). |
| 292 | 5 inches (13 cm). |
| 293 | 3 inches (7.6 cm). |
| 294 | 4 inches (10 cm). |
| 295 | 10 inches (25 cm). |
| 296 | 12 inches (30 cm). |
| 297 | 1-½ inches (3.8 cm). |
| 298 | ½-inch (1.3-cm) radius. |
| 299 | ¾-inch (1.9-cm) radius. |

Such dimensions may be considered to be approximate.

By employing a mat of the invention, to include mats 1000, 1100 & 1200, the familiar bounce-back or shock, which is commonly encountered with conventional practice mats, can generally be eliminated, and what is more, most authentic practice can be obtained. The generally U-shaped platform, open on one side and supported on remaining sides, plays a most important role in this respect, and with it, the mat provides a most "soft" feel during the swing. In general, unlike that which is touted by purveyors of conventional golf mats, thick or highly padded artificial turf is not relevant to providing such a "soft" feel, which conventional mats cannot provide. With a mat of this invention, the golfer 9 can practice a fluid iron stroke generally without mat-caused interruption, as he is able to and can be encouraged to realistically practice hitting down and through the ball 8 as is to be done with an iron shot to obtain good backspin. It is the backspin which provides for the loft of the shot and for the stopping power of the well struck iron, particularly the short iron, shot.

The mat of the invention is most adaptable to practicing not only shots with the driver or woods but also irons where the club head is directed into the turf after striking the ball. Instruction may be by a teacher or by self-teaching. The mat hereof can provide for highly authentic golf swing practice, especially with balls within three inches of the follow through notch, in a durable, efficient format.

In certain aspects, the present invention can be considered to be an improvement of the golf swing training mat of the aforementioned Durso documents, U.S. Pat. No. 5035433 and WO 92/01496. In certain other, more broad aspects, such as the provision of the tee and turf slots and so forth, the present invention may be considered to be an improvement in other practice pads and mats, to include conventional ones.

The invention is praised by amateur and pro golfers.

CONCLUSION

The present invention is thus provided. Numerous modifications can be effected within its spirit, the literal claim scope of which is particularly pointed out as follows:

I claim:

1. A golf swing training mat for highly authentic practice comprising the following:

a support surface;

a standing surface;

a hitting surface separate from the standing surface and removably attachable to the support surface and having an area thereof designated as a front hitting area, at least partly overhanging an underpass space, unsupported about the front hitting area but having and being supported on at least one forwardly directed side, and which hitting surface is made of a material that nearly looks and gives a feeling of real grass and that is not easily destroyed by repeated swings of a golf club striking the material; and a follow through notch ahead of the hitting surface in part defined by an obliquely-angled edge generally obliquely angled to and abutting a front edge of the hitting surface, which envoids an area such that a golfer when swinging an iron can properly continue downwardly after striking a golf ball with the iron into the downwardmost portion of the swing after the ball is struck near the front hitting area, and which also allows for the golfer to follow through in a practice swing without striking the obliquely-angled edge segment such that the golfer is able to and can be encouraged to realistically practice hitting down and through the ball as is to be done with an iron shot to obtain good backspin, and hence, loft, and such that bounce-back or shock can generally be eliminated, and the golfer can thus practice a fluid iron stroke generally without mat-caused interruption.

2. The mat of claim 1, wherein part of the front hitting area overhangs a generally U-shaped boundary underpass space, the same including a platform open on one side and supported on remaining sides.

3. The mat of claim 1, wherein the front hitting area which overhangs the underpass space is supported by an extension of the support surface; the hitting surface and support surface are reversibly attachable by a hook and loop material, and the extension of the support surface has a part of the hook and loop material thereon and extends further in the direction of the follow through notch than does a front edge of the hitting surface.

4. The mat of claim 3, in combination with and further comprising at least one of the following features:

A) a turf slot in the front hitting area, which is capable of retaining a golf ball therein so that the ball nestles into the hitting surface turf material deeper than would be the case if the ball were placed on the turf material itself; and B) a cul-de-sac shaped tee slot in the extension of the support surface, which can accommodate the positioning of a rubber practice tee for a golf ball having a base and a post by slipping the post of the tee sidewardly through a neck of the slot from outside the extension such that the post rest in a larger hole of the slot with the tee base under the extension; and a hole in the hitting surface turf material to accommodate the tee post—such that the tee is adjustable in height by snug fitting with the hole(s).

5. The mat of claim 4, having at least the turf slot.

6. The mat of claim 4, having at least the tee slot.

7. The mat of claim 1, further comprising at least one of the following features:

A turf slot in the front hitting area, which is capable of retaining a golf ball therein so that the ball nestles into the hitting surface turf material deeper than would be the case if the ball were placed on the turf material itself;

A set of tee openings in the base, the support surface, and the hitting surface turf material, which can accommodate the positioning of a rubber practice tee for a golf ball having a base and a post by inserting the post of the tee upwardly the openings in the support surface and hitting surface turf material to accommodate the tee post, with a larger opening in the base to accommodate the base of the tee—such that the tee is adjustable in height by snug fitting with at least the opening in the support surface.

8. The mat of claim 2, further comprising at least one of the following features:

A turf slot in the front hitting area, which is capable of retaining a golf ball therein so that the ball nestles into the hitting surface turf material deeper than would be the case if the ball were placed on the turf material itself;

A set of tee openings in the base, the support surface, and the hitting surface turf material, which can accommodate the positioning of a rubber practice tee for a golf ball having a base and a post by inserting the post of the tee upwardly the openings in the support surface and hitting surface turf material to accommodate the tee post, with a larger opening in the base to accommodate the base of the tee—such that the tee is adjustable in height by snug fitting with at least the opening in the support surface.

9. The mat of claim 1, wherein the support surface includes a plurality of pieces, which include standing area base pieces and at least one hitting area base piece.

10. The mat of claim 9, wherein said base pieces interlock by means of a tab and recess arrangement.

11. The mat of claim 10, wherein the support surface includes an intermediate support surface which lies on top of said base pieces and under said standing and hitting surfaces.

12. The mat of claim 11, wherein the hitting area base piece has symmetrically arranged tabs and recesses for interlocking with either left or right hand side of the standing area base pieces.

13. The mat of claim 12, wherein the at least one hitting area base piece includes a one-piece, bilevel, hitting and divot area part, and which mat can have hitting surfaces on both left and right hand sides of the standing area and a plurality of standing surfaces.

14. The mat of claim 12, wherein the base pieces are made of a rubber composition.

15. The mat of claim 1, wherein the support surface includes a one-piece base.

16. The mat of claim 15, wherein the unsupported area in the hitting surface designated as the front hitting area is supported with sides in the form of a circle, oval or square.

17. A method for providing golf swing instruction comprising providing a golf swing training mat for highly authentic practice including a support surface; a standing surface; a hitting surface separate from the standing surface and removably attachable to the support surface and having an area thereof designated as a front hitting area, at least partly overhanging an underpass space, unsupported about the front hitting area but having and being supported on at least one forwardly directed side, and which hitting surface is made of a material that nearly looks and gives a feeling of real grass and that is not easily destroyed by repeated swings of a golf club striking the material; and a follow through notch ahead of the hitting surface in part defined by an obliquely-angled edge generally obliquely angled to and abutting a front edge of the hitting surface, which envoids an area such that a golfer when swinging an iron can properly continue downwardly after striking a golf ball with the iron into the downwardmost portion of the swing after the ball is struck near the front hitting area, and which also allows for the golfer to follow through in a practice swing without striking the obliquely-angled edge segment—such that the golfer is able to and can be encouraged to realistically practice hitting down and through the ball as is to be done with an iron shot to obtain good backspin, and hence, loft, and such that bounce-back or shock can generally be eliminated, and the golfer can thus practice a fluid iron stroke generally without mat-caused interruption—and providing a golf ball, and a golf club, placing the ball on the front hitting area of the hitting surface within three inches of its forward edge behind the follow through notch, and swinging or directing swinging of the golf club at the golf ball so placed.

18. The method of claim 17, wherein a turf slot is employed in placement of the ball on the front hitting area.

19. The method of claim 17, wherein a set of tee openings in the base, the support surface, and the hitting surface turf material, which can accommodate the positioning of a rubber practice tee for a golf ball having a base and a post by inserting the post of the tee upwardly the openings in the support surface and hitting surface turf material to accommodate the tee post, with a larger opening in the base to accommodate the base of the tee, are present in combination with the mat such that the tee is adjustable in height by snug fitting with at least the opening in the support surface.

* * * * *